US006116954A

United States Patent [19]

Ries

[11] Patent Number: 6,116,954

[45] Date of Patent: Sep. 12, 2000

[54] ELECTRICAL CONNECTOR FOR MAKING CONTACT WITH AT LEAST ONE FLAT FOIL CONDUCTOR

[75] Inventor: Annette Carola Ries, Rodenbach, Germany

[73] Assignee: The Whitaker Corporation, Wilmington, Del.

[21] Appl. No.: 09/277,843

[22] Filed: Mar. 29, 1999

[51] Int. Cl.[7] ..... H01R 13/434

[52] U.S. Cl. ..... 439/596; 439/752; 439/423

[58] Field of Search ..... 439/752, 596, 439/421–424, 701

[56] References Cited

U.S. PATENT DOCUMENTS

| | | | |
|---|---|---|---|
| 4,082,402 | 4/1978 | Kinkaid et al. | 439/422 |
| 4,669,798 | 6/1987 | Daum et al. | 439/423 |
| 4,750,893 | 6/1988 | Sueyoshi et al. | 439/596 |
| 5,586,918 | 12/1996 | Chemin | 439/762 |

FOREIGN PATENT DOCUMENTS

| | | | |
|---|---|---|---|
| 0 810 122 A2 | 12/1997 | European Pat. Off. | B60R 16/02 |

*Primary Examiner*—Gary F. Paumen

[57] ABSTRACT

An electrical connector for contacting at least one flat foil conductor and for connecting it with a complementary connector, the connector having a first housing with at least one chamber for accommodating an electrical contact in a latched position, a second outer housing for accommodating the first housing in a pre-latched position in which the flat foil conductor can be connected to the contact and in a latched end position, a flap attached to the second outer housing which can only be closed in the latched end position of the first housing within the outer housing and which prevents the first housing from being removed from the outer housing and the contact from being removed from the chamber, and at least one contact which latches into the chamber and which is provided with a foil contact area.

12 Claims, 5 Drawing Sheets

ELECTRICAL CONNECTOR FOR MAKING CONTACT WITH AT LEAST ONE FLAT FOIL CONDUCTOR

BACKGROUND OF THE INVENTION

1. Field of the Invention

This invention relates to an electrical connector for making contact with at least one flat foil conductor and for interconnecting to a complementary connector.

2. Description of the Prior Art

U.S. Pat. No. 4,669,798 discloses an electrical contact for connection with flat foil conductors. The subject relates to a flexible circuit board to which electrical contact is made by the contact. This contact provides for making contact with a complementary contact pin on one side and for making contact with the foil on the other side. The portion that makes contact with the foil is provided with a rib with tabs arranged at its sides which penetrate the foil and can be crimped onto the foil. Thus, a connection is made between the contact and the foil conductor.

A contact configuration for ribbon cable is also known from EP 810 122. This ribbon cable is also a flat or flexible type foil with conductors. A housing is provided into which the ribbon cable is inserted where direct contact is made with the individual discrete conductors.

Many applications for flat foil conductors or flexible PCBs require them to be equipped with connectors. The fitting of the flat foil conductor can be relatively complicated if at first individual contacts need to be crimped onto the conductors and are subsequently required to be fitted into a housing.

SUMMARY OF THE INVENTION

It is the object of the invention to provide a connector for making contact with at least one flat foil conductor which facilitates the establishing of a connection between the connector and the flat foil conductor.

The problem is solved by an electrical connector comprising a first housing with at least one chamber for the acceptance of an electrical contact in a latched position, at least one contact which latches into the chamber and which is provided with a foil contact area, a second outer housing for accepting the first housing in a pre-latched position where the flat foil conductor can be connected with the contact, and in a latched end position, a flap attached to the second outer housing which can only be closed in the latched end position of the first housing within the second outer housing that secures the first housing against removal from the outer housing as well as the contact against removal from the chamber.

With a connector according to the invention the connection with a flat foil conductor can be carried out as follows. In a first housing several chambers are arranged in a row to accept electrical contacts. The chambers are provided with electrical contacts which are in a latched end position, advantageously by means of a latching tab spring. The first housing is located in a pre-latched position within a second outer housing. The contacts feature a foil contact area. The first housing is provided with a window around the foil contact area which is situated in such a way that the foil contact area is accessible from above and below. This window is freely accessible in the pre-latched position (when the first housing is latched onto the second outer housing). A portion of a foil can now be inserted into the foil contact area. With the aid of a tool which grips the foil contact areas from above and below, the foil can be pushed onto the contact areas and attached to the same. This can be effected, for example, by providing within the foil contact area a rib with tabs at the side which would be pressed through the foil and then crimped around it. For crimping purposes an anvil would be lowered through the window of the first housing which would serve as a stop for the upper part of the crimping tool.

Having thus attached the flat foil to the contacts, the first housing is inserted into the second outer housing where it is put into a latched end position and locked. The window in the first housing is no longer accessible since it is protected by the second outer housing. A flap on the second outer housing can now be shut thus locking the first housing in so that it can no longer be removed from the outer housing. The flap further secures the contacts in the chambers. The foil contact area is now no longer accessible from the outside.

It is particularly advantageous that the contact making with the flat foil conductor can be carried out for all contacts at the same time. This is the case if the foil contact area is provided with tabs for penetrating and crimping the foil, as it is then possible to attach all contacts to the flat foil in one single operation.

Furthermore it is particularly advantageous that the outer housing and the flap are of one piece. This is possible if the flap is attached to the outer housing by means of a film type hinge. This would contribute to fewer separate parts being involved.

A further particular advantage lies in that the flap has a pre-latched and a latched end position with respect to the outer housing. This ensures that the film type hinge is not be strained, since the flap only moves between these two positions.

Another particular advantage is that the flap prevents the removal of the contacts from the chambers and also the removal of the first housing from the outer housing. To this end, the first housing is provided with a locking aperture through which a locking projection on the flap would engage with the first housing. The locking projection on the flap would travel through this locking aperture in the first housing and also engage in the various chambers thus securing the contacts. It is possible to provide one locking tab which would cover the full length of the flap, but a separate locking tab for each individual chamber is also a possibility.

Another special advantage is that the connector can be supplied in a pre-assembled state for the purpose of attaching the connector to the foil. A pre-assembled state is made possible in that the first housing can be latched into the second housing in both a pre-latched and latched end position.

DETAILED DESCRIPTION OF THE PREFERRED EMBODIMENT

Figure 2:
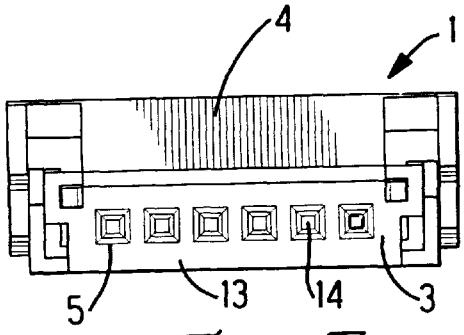
FIG. 2 is a facial view of the configuration according to FIG. 1.
Figure 3:
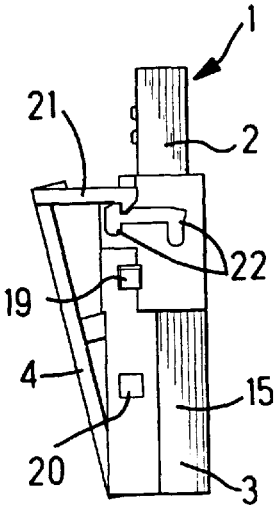
FIG. 3 is a side view of the configuration according to FIG. 1.
Figure 1:
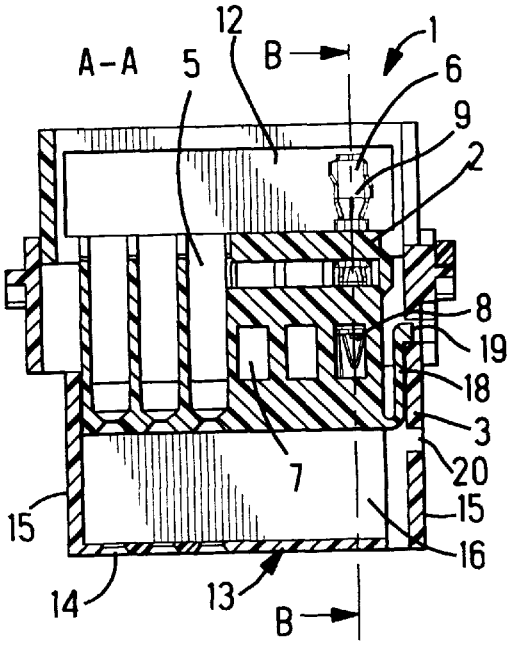
FIG. 1 is a cross-sectional view through a connector according to the invention with a first housing in pre-latched position.
Figure 4:
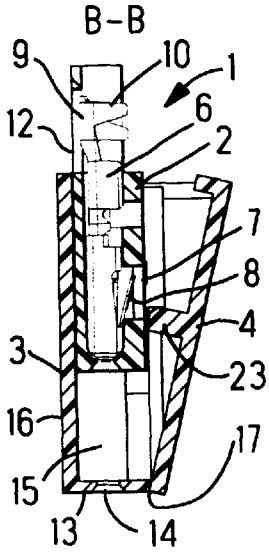
FIG. 4 is a cross-sectional view along the section line B—B according to FIG. 1.
Figure 5:
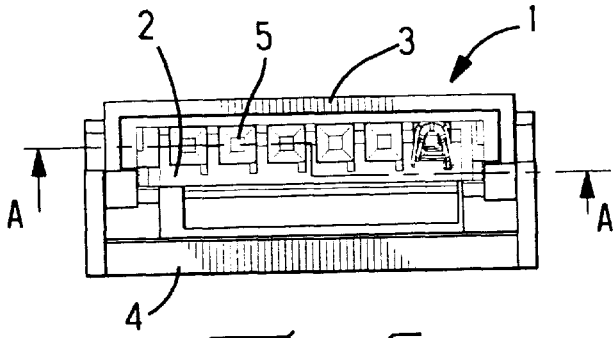
FIG. 5 is a view on the side from which the flat foil is inserted into the connector according to FIG. 1.
Figure 7:
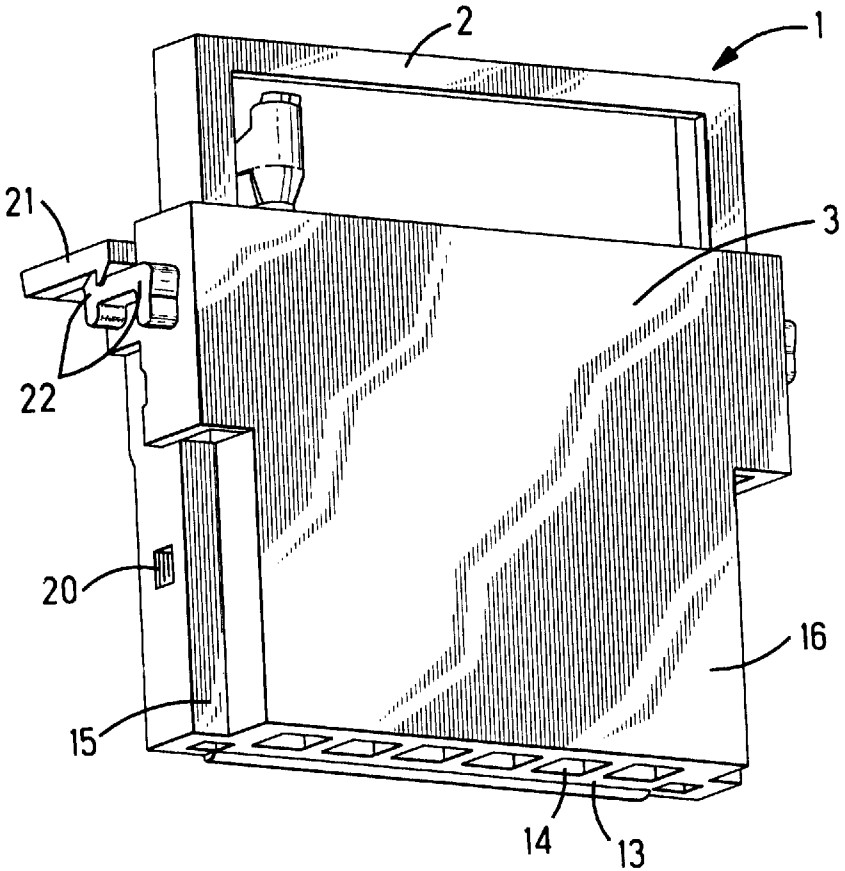
FIG. 7 is a rear isometric view of the connector according to FIG. 1.
Figure 6:
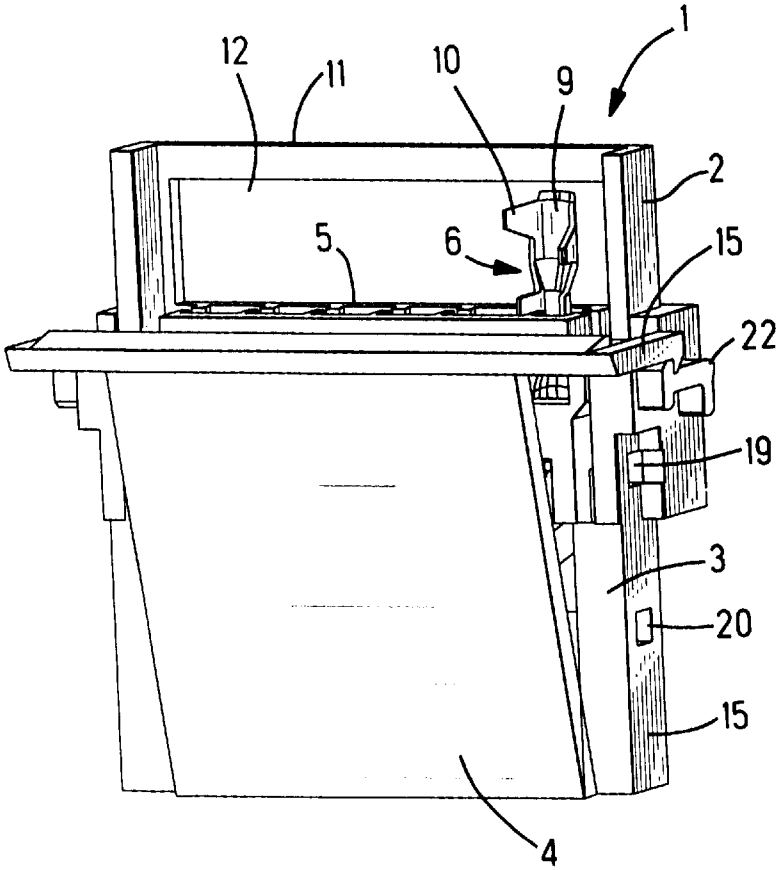
FIG. 6 is an isometric view of the connector according to FIG. 1.
Figure 9:
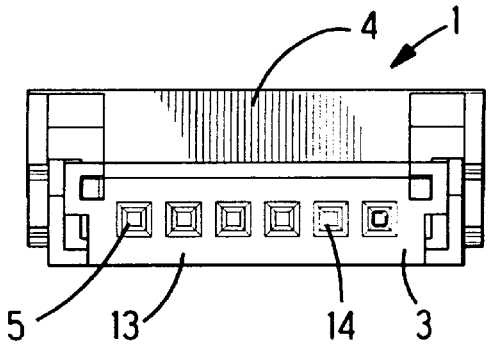
FIG. 9 is a facial view of FIG. 8.
Figure 10:
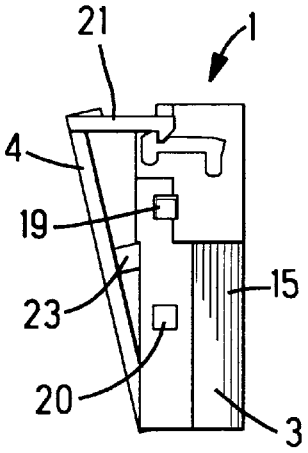
FIG. 10 is a side view of FIG. 8.
Figure 8:
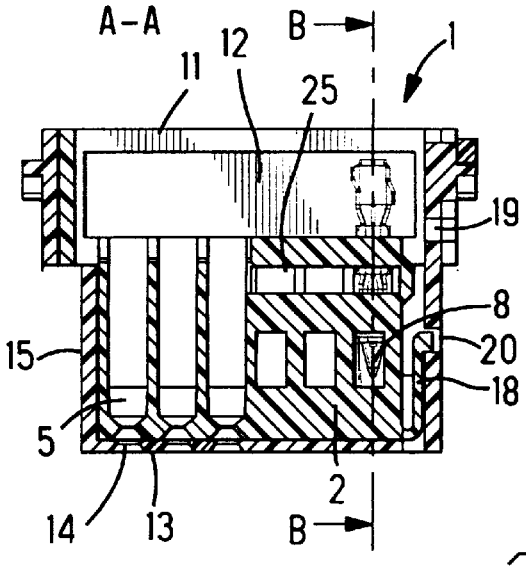
FIG. 8 shows a cross-section through a connector with the first housing in latched end position but with open flap.
Figure 11:
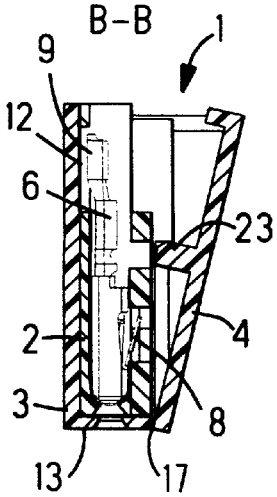
FIG. 11 is a cross-sectional view along the section line B—B of FIG. 8.
Figure 12:
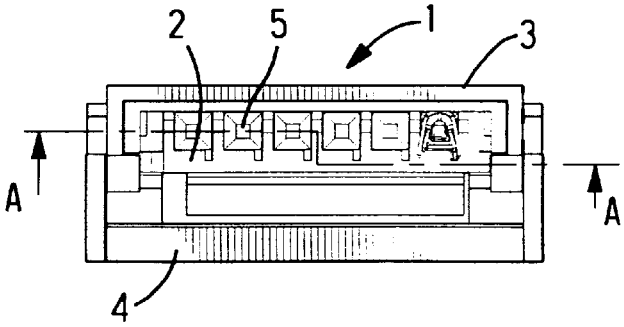
FIG. 12 is a rear view of FIG. 8.
Figure 14:
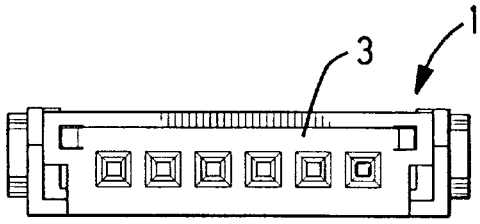
FIG. 14 is a facial view of the connector according to FIG. 13.
Figure 15:
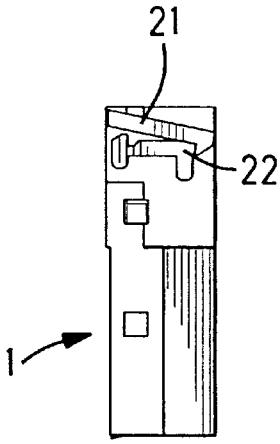
FIG. 15 is a side view of the connector according to FIG. 13.
Figure 13:
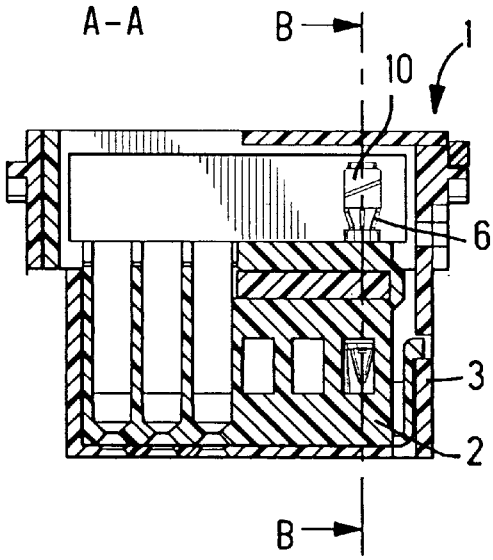
FIG. 13 is a cross-sectional view of a connector with first housing and articulated flap in latched end position.
Figure 16:
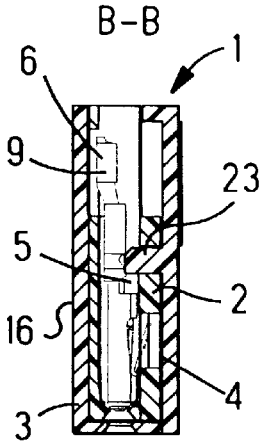
FIG. 16 is a cross-sectional view along line B—B in FIG. 13.
Figure 17:
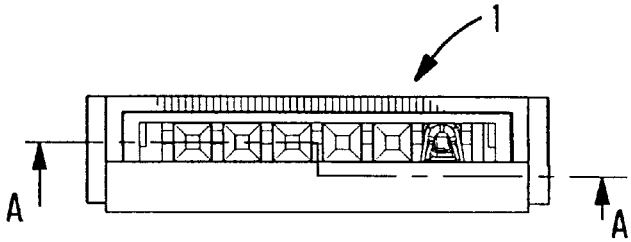
FIG. 17 is a rear view of the connector according to FIG. 13.

An electrical connector 1 with a first housing 2 in a pre-latched position within a second housing 3 having a flap 3 according to the invention shall be explained by way of FIGS. 1 to 7. In this embodiment, the first housing 2 is provided with six chambers 5 arranged in a row. Each of the chambers 5 is intended to accommodate an electrical contact 6. Each chamber 5 is provided with a first opening 7 in one side wall. This first opening 7 accepts a latching spring tab 8 of the contact 6 so the contact 6 is latched into the first housing 2. In this embodiment, contact 6 is designed as a socket type contact. However, it is also possible to provide pin type contacts.

Each contact 6 has a foil contact area 9. The foil contact area 9 consists of a rib and tabs 10 on the opposite sides of the rib. The tabs 10 are for penetrating a foil and for crimping onto the foil so that contact is made with the flat foil conductor.

The first housing 2 is provided with a frame 11 in the foil contact area 9 of the contacts 6 which surrounds a window 12. Through the window 12 the foil contact areas 9 of the contacts 6 are freely accessible from below. Since the first housing 2 within the area of the frame 11 is not provided with an upper wall, the foil contact areas 9 are also accessible from above. It is possible to attach a foil to the foil contact areas 9 of the contacts 6 when the contacts 6 in the first housing 2 are latched in position.

The second, outer housing 3 accommodates the first housing 2. The second outer housing 3 is provided with an end wall 13 with openings 14. Through the openings 14 the chambers 5 of the first housing 2 are accessible. In addition, the second housing is provided with two side walls 15 and a back wall 16. A front wall is formed by the flap 4. The flap 4 is attached to the second housing 3 via a film type hinge 17. The film type hinge 17 joins on to the end wall 13 of the second housing 3.

The first housing 2 is provided along the side with a locking arm 18 which can be locked into a pre-latched and a latched end position in the second outer housing 3. The second outer housing 3 has openings 19 and 20 in the side walls 15 for the pre-latched and latched end position.

The flap 4 is provided with a latching arm 21 along each side. This latching arm 21 engages with the corresponding latching lugs 22 at the side wall 15 of the second outer housing 3. FIGS. 1 to 7 show the flap 4 in the pre-latched position. The flap 4 is provided with a locking projection 23 running over the full length.

If the first housing 2 is in the pre-latched position within the second housing 3, the travel of the locking projection is stopped by the first housing 2 which prevents the closing of the flap. The window 12 and the foil contact areas 9 of the contacts 6 are freely accessible if the first housing 2 is in the pre-latched position within the second outer housing. It is in this position that the foil can be attached.

With the aid of FIGS. 8 to 12 a connector according to the invention is now to be explained where the first housing 2 is in the locked end position but where the flap 4 is not yet closed. Identical parts relating to FIGS. 1 to 7 and 8 to 12 are provided with the same reference signs. The first housing 2 is now in the latched end position within the second outer housing 3. The locking arm 18 is now locked into the opening 20 in the side wall 15 of the outer housing 3. The frame 11 with the window 12 is totally within the outer housing. The window 12 is no longer accessible from the outside.

Figure 19:
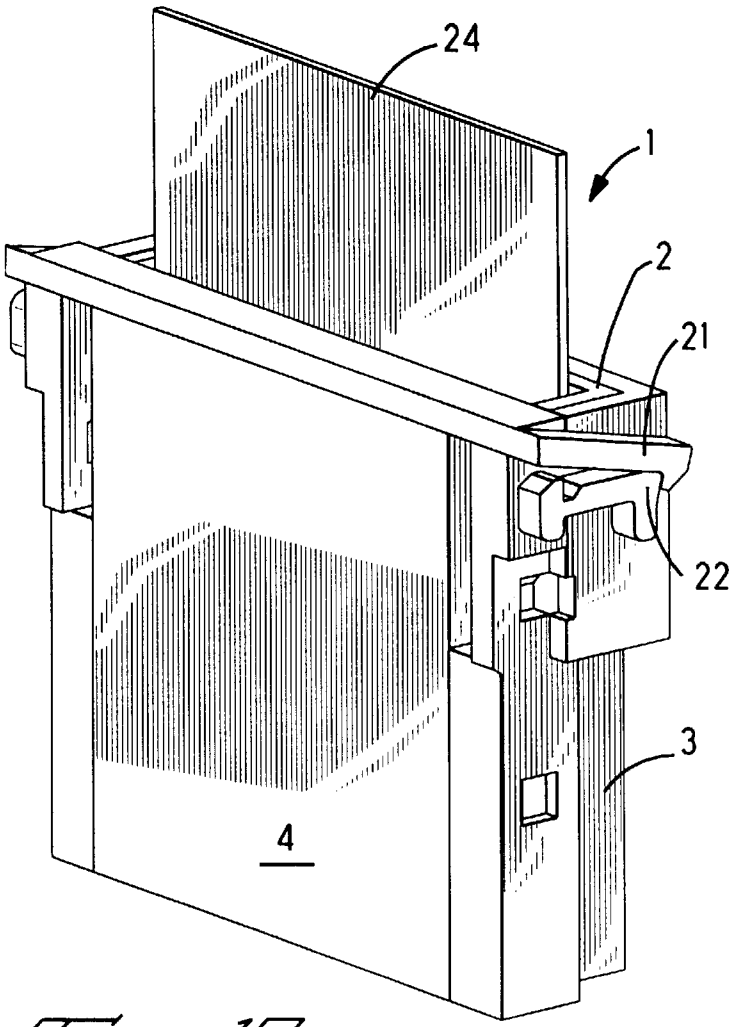
FIG. 19 is another isometric view of the connector according to FIG. 13 with inserted flat foil.
Figure 18:
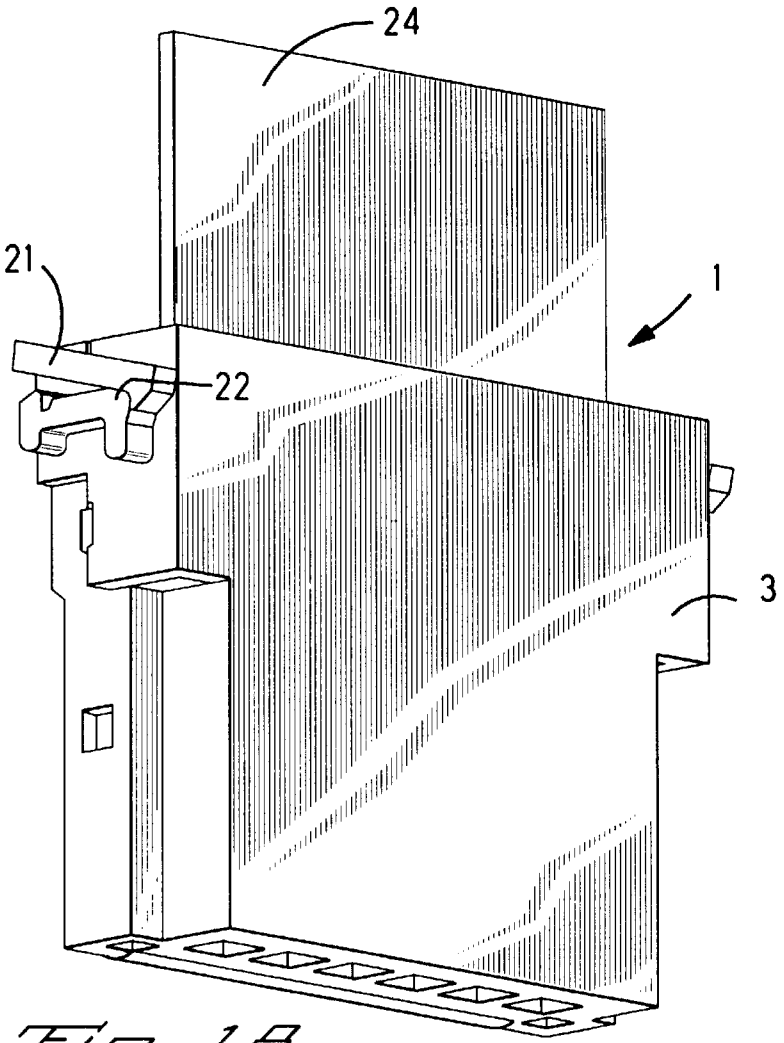
FIG. 18 is an isometric view of the connector according to FIG. 13 with inserted flat foil.

The connector, with flap 4 closed, is now disclosed in FIGS. 13 to 19. FIGS. 18 and 19 show a flat or flexible plastic film 24 which carries the conductors either between two layers or on top of the plastic film. The tabs 10 of the contact 6 are crimped over. The first housing 2 is in the latched end position in the second outer housing 3. The flap 4 runs parallel to the back wall 16 of the second outer housing. The latching arms 21 latch in behind the latching lug 22 in the latched end position.

The locking projection 23 travels through a locking opening 25 in the first housing 2 which is provided for all chambers 5. The locking projection 23 travels through this locking opening 25 through the housing 2 thus locking the first housing 2 with the outer housing 3. In addition the locking projection 23 engages in chamber 5 thus reducing the cross-section of the chamber. The contact 6 is secured in chamber 5 by this action. The foil contact area 9 of contact 6 is no longer accessible from the outside.

I claim:

1. An electrical connector for contacting at least one flat foil conductor and for connecting with a complementary connector, comprising a first housing with at least one chamber for the acceptance of an electrical contact in a latched position, at least one electrical contact that latches into the chamber and that is provided with a foil contact area, a second outer housing for accepting the first housing in a pre-latched position where the flat foil conductor can be connected with the contact, and in a latched end position, a flap attached to the second outer housing that can only be closed in the latched end position of the first housing within the second outer housing and that secures the first housing against removal from the outer housing as well as the contact against removal from the chamber.

2. The connector according to claim 1, wherein the foil contact area is provided with tabs for penetrating the foil and for crimping onto the foil.

3. The connector according to claim 1, wherein several chambers are arranged in one row.

4. The connector according to claim 1, wherein the flap at the outer housing is attached by means of a film type hinge.

5. The connector according to claim 1, wherein the flap is provided with a latching arm on each side which engages with latching lugs at the side of the outer housing and which provides a pre-latched and a latched end position.

6. The connector according to claim 1, wherein the flap is provided with a locking projection over the entire length with which it engages into the chamber.

7. The connector according to claim 1, wherein the flap is provided with a locking projection for each chamber which engages with the chambers.

8. The connector according to claim 1, wherein the housing is provided with a locking arm on at least one side to engage with an opening in a side wall of the outer housing.

9. The connector according to claim 1, wherein the contacts are provided with a latching spring tab for latching into the first housing.

10. The connector according to claim 1, wherein the contacts are designed as socket type contacts.

11. The connector according to claim 1, wherein the first housing is a socket type housing.

12. The connector according to claim 1, wherein the first housing is provided with a window in such a way that the foil contact area of the contact is freely accessible from above and below.

* * * * *